US008939106B2

(12) United States Patent
Takahashi

(10) Patent No.: US 8,939,106 B2
(45) Date of Patent: Jan. 27, 2015

(54) PAINTING SYSTEM

(75) Inventor: Shingi Takahashi, Fukuoka (JP)

(73) Assignee: Kabushiki Kaisha Yaskawa Denki, Kitakyushu-Shi (JP)

( * ) Notice: Subject to any disclaimer, the term of this patent is extended or adjusted under 35 U.S.C. 154(b) by 179 days.

(21) Appl. No.: 13/494,997

(22) Filed: Jun. 13, 2012

(65) Prior Publication Data

US 2012/0325142 A1 Dec. 27, 2012

(30) Foreign Application Priority Data

Jun. 24, 2011 (JP) ..... 2011-140295

(51) Int. Cl.

| | |
|---|---|
| ***B05B 15/12*** | (2006.01) |
| ***B05B 3/00*** | (2006.01) |
| ***B05B 7/06*** | (2006.01) |
| ***B05C 11/10*** | (2006.01) |
| ***B05B 13/04*** | (2006.01) |

(52) U.S. Cl.

CPC ..... *B05B 13/0452* (2013.01); *B05B 15/1214* (2013.01); *B05B 13/0431* (2013.01); *Y10S 901/43* (2013.01)

USPC ..... 118/323; 118/326; 118/321; 118/309; 118/324; 118/634; 118/698; 118/681; 901/43

(58) Field of Classification Search

CPC ..... B05B 13/0431; B05B 13/0452; B05B 15/1214

USPC ..... 118/323, 326, 321, 309, 634, 324, 118/679–681, 695–698; 901/15, 27, 29, 41, 901/43; 700/245; 74/490.04; 427/427.2, 427/427.3

See application file for complete search history.

(56) References Cited

U.S. PATENT DOCUMENTS

| | | | | |
|---|---|---|---|---|
| 5,014,644 | A * | 5/1991 | Yamamoto et al. | 118/314 |
| 5,781,705 | A | 7/1998 | Endo | |
| 6,776,843 | B2 * | 8/2004 | Fouvet et al. | 118/323 |
| 7,429,298 | B2 * | 9/2008 | Krogedal et al. | 118/323 |
| 7,638,000 | B2 * | 12/2009 | Clifford et al. | 118/323 |
| 2006/0292308 | A1 * | 12/2006 | Clifford et al. | 427/427.2 |
| 2011/0166708 | A1 * | 7/2011 | Herre et al. | 700/258 |

FOREIGN PATENT DOCUMENTS

| | | |
|---|---|---|
| DE | 102008038761 | 2/2010 |
| EP | 0771621 | 5/1997 |
| EP | 2095884 | 9/2009 |
| EP | 2286927 | 2/2011 |

(Continued)

OTHER PUBLICATIONS

Full English Translation of Patent Application Publication S63-267177A, Nov. 4, 1988.*

Japanese Office Action for corresponding JP Application No. 2011-140295, Jul. 16, 2013.

Yilong Chen et al., A Unified Optimization Approach for a (6+1)-Axis Robot System, Proceedings of the International Conference on Systems, Man and Cybernetics, Oct. 17, 1993, pp. 550-565.

(Continued)

*Primary Examiner* — Yewebdar Tadesse

(74) *Attorney, Agent, or Firm* — Mori & Ward, LLP

(57) ABSTRACT

A painting system according to the embodiments includes a painting booth surrounded by a ceiling and a sidewall, a conveyor line that is arranged in the painting booth and conveys an object to be painted, and a painting robot that performs painting on the object. The painting robot includes a base portion fixed on the sidewall side in the painting booth, and an arm portion that is connected to the base portion and has a seven-axis configuration.

15 Claims, 12 Drawing Sheets

(56) References Cited

FOREIGN PATENT DOCUMENTS

| | | |
|---|---|---|
| JP | 63-267177 | 11/1988 |
| JP | 01-194959 | 8/1989 |
| JP | 04-090867 | 3/1992 |
| JP | 2006-095614 | 4/2006 |
| JP | 2009-125783 | 6/2009 |
| JP | 2010-137204 | 6/2010 |

OTHER PUBLICATIONS

Extended European Search Report for corresponding EP Application No. 12170662.6-2425, Sep. 13, 2012.
Korean Office Action for corresponding KR Application No. 10-2012-0066805, Aug. 14, 2014.
Chinese Office Action for corresponding CN Application No. 201210212587.3, Nov. 15, 2014.

* cited by examiner

PAINTING SYSTEM

CROSS-REFERENCE TO RELATED APPLICATION

This application is based upon and claims the benefit of priority of the prior Japanese Patent Application No. 2011-140295, filed on Jun. 24, 2011, the entire contents of which are incorporated herein by reference.

FIELD

The embodiments discussed herein are directed to a painting system.

BACKGROUND

Conventionally, a robot is known in which a base portion is fixed to the floor and an arm portion having a seven-axis configuration is connected to the base portion (for example, see Japanese Patent Laid-open Publication 2009-125783). The robot is provided with an end effector according to the work purpose at the tip of the arm portion having a seven-axis configuration and the robot performs the work by controlling the end effector to the position and posture according to the work.

The above-described conventional robot can be used as a painting robot by attaching, for example, a painting gun as the end effector to the tip of the arm portion. In a painting booth in which the painting robot is arranged, airflow control of preventing splashing of paint is performed in addition to air-conditioning control of temperature, humidity, and the like. As the painting booth becomes larger, the device that performs air-conditioning control and airflow control becomes larger and consumes more energy. Thus, it is desirable to reduce the size of the painting booth in the painting system.

However, when the above-described conventional robot is used as a painting robot, space is needed for fixing the base portion to the floor of the painting booth. Therefore, there is a problem in reducing the size of the painting booth.

SUMMARY

A painting system according to an aspect of the embodiments includes a painting booth surrounded by a sidewall and a ceiling, a conveyor line that is arranged in the painting booth and conveys an object to be painted, and a painting robot that performs painting on the object. The painting robot includes a base portion fixed on the sidewall side in the painting booth and an arm portion that is connected to the base portion and has a seven-axis configuration.

BRIEF DESCRIPTION OF DRAWINGS

A more complete appreciation of the invention and many of the attendant advantages thereof will be readily obtained as the same becomes better understood by reference to the following detailed description when considered in connection with the accompanying drawings, wherein.

DESCRIPTION OF EMBODIMENTS

Hereinafter, embodiments of a painting system disclosed in the present application will be described in detail based on the drawings. This invention is not limited to these embodiments. In the following, the positive side of the Y axis is defined as a right side, the negative side of the Y axis is defined as a left side, the positive side of the Z axis is defined as an upper side, the negative side of the Z axis is defined as a lower side, the positive side of the X axis is defined as a back side, and the negative side of the X axis is defined as a front side.

First Embodiment

Figure 1:
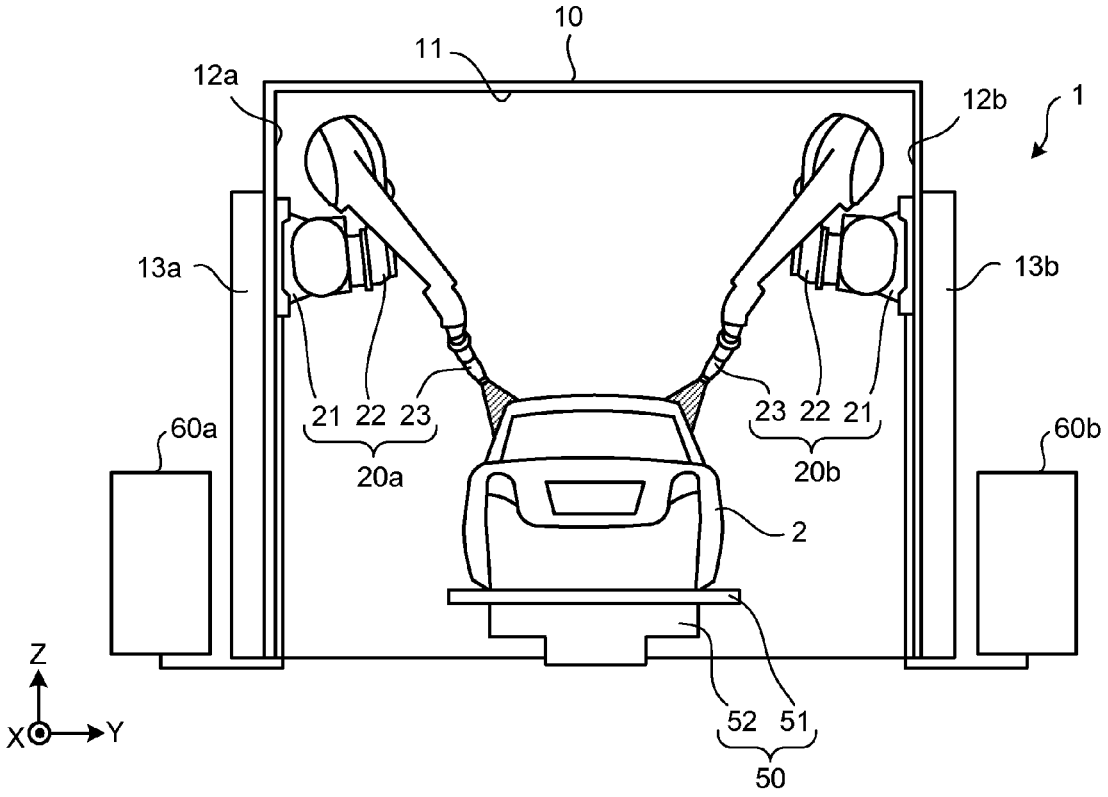
FIG. 1 is a diagram schematically illustrating a configuration of a painting system according to a first embodiment.

First, a painting system according to the first embodiment will be explained. FIG. 1 is a diagram schematically illustrating a configuration of a painting system 1 according to the first embodiment.

As shown in FIG. 1, the painting system 1 according to the first embodiment includes a painting booth 10, painting robots 20*a* and 20*b*, a conveyor line 50, and control devices 60*a* and 60*b*. The painting robot 20*a* is controlled by the control device 60*a* and the painting robot 20*b* is controlled by the control device 60*b*. Although not shown, in the painting system 1, for example, a device that performs air-conditioning control in the painting booth 10, a device that performs airflow control to prevent splashing of paint sprayed during painting, and the like are arranged in the painting system 1.

The painting booth 10 is a booth surrounded by a ceiling 11, a left sidewall 12*a*, and a right sidewall 12*b*. A left support post 13*a* and a right support post 13*b* are arranged on the outside of the painting booth 10. The left support post 13*a* is arranged along the lateral surface of the left sidewall 12*a* and the right support post 13*b* is arranged along the lateral surface of the right sidewall 12*b*.

The painting robots 20*a* and 20*b* are painting robots having an internal pressure explosion-proof structure with which a motor driving each joint is arranged in an airtight chamber. Each of the painting robots 20*a* and 20*b* includes a base portion 21 fixed on the sidewall 12*a* or 12*b* side in the painting booth 10 and an arm portion 22 having a seven-axis configuration connected to the base portion 21. A painting gun 23 is attached to the tip of each arm portion 22 and the position and posture of the painting guns 23 are controlled by controlling the arm portions 22 by the control devices 60*a* and 60*b*.

The painting robots 20*a* and 20*b* paint the left half and the right half of an object 2 to be painted on the basis of the control by the control devices 60*a* and 60*b*, respectively.

Specifically, the painting robot 20*a* paints the left half of the object 2 by the painting gun 23 attached to the tip of the arm portion 22 on the basis of the control by the control device 60*a*. The painting robot 20*b* paints the right half of the object 2 by the painting gun 23 attached to the tip of the arm portion 22 on the basis of the control by the control device 60*b*.

The conveyor line 50 is a device that conveys the object 2 in the forward direction (negative direction of the X axis) and includes a mounting table 51 to mount the object 2 on the upper surface thereof and a movement mechanism 52 that moves the mounting table 51 in the forward direction. Each of the control devices 60*a* and 60*b* controls the position and posture of the painting gun 23 attached to the tip of the arm portion 22 by controlling the arm portion 22 of the painting robot 20*a* or 20*b*. Then, each of the control devices 60*a* and 60*b* paints the object 2 mounted on the mounting table 51 of the conveyor line 50 by spraying paint from the painting gun 23 while controlling the position and posture of the painting gun 23.

In this manner, the painting system 1 conveys the object 2 by the conveyor line 50 and paints the object 2 by the painting robots 20*a* and 20*b*. In the painting system 1, the base portion 21 of each of the painting robots 20*a* and 20*b* is fixed on the sidewall 12*a* or 12*b* side at a position higher than the object 2. Therefore, the width of the painting booth 10 in the horizontal direction can be made small compared with a painting booth including a painting robot whose base portion is fixed to the floor, and as a result, the painting booth 10 can be reduced in size.

If the sidewalls 12*a* and 12*b* have a strength sufficient to hold the painting robots 20*a* and 20*b*, the base portions 21 of the painting robots 20*a* and 20*b* can be directly fixed to the sidewalls 12*a* and 12*b*. That means that the base portions 21 may be fixed on the sidewalls 12*a* and 12*b* side by being fixed to the support posts 13*a* and 13*b* or by being fixed to the sidewalls 12*a* and 12*b* themselves.

Figure 2:
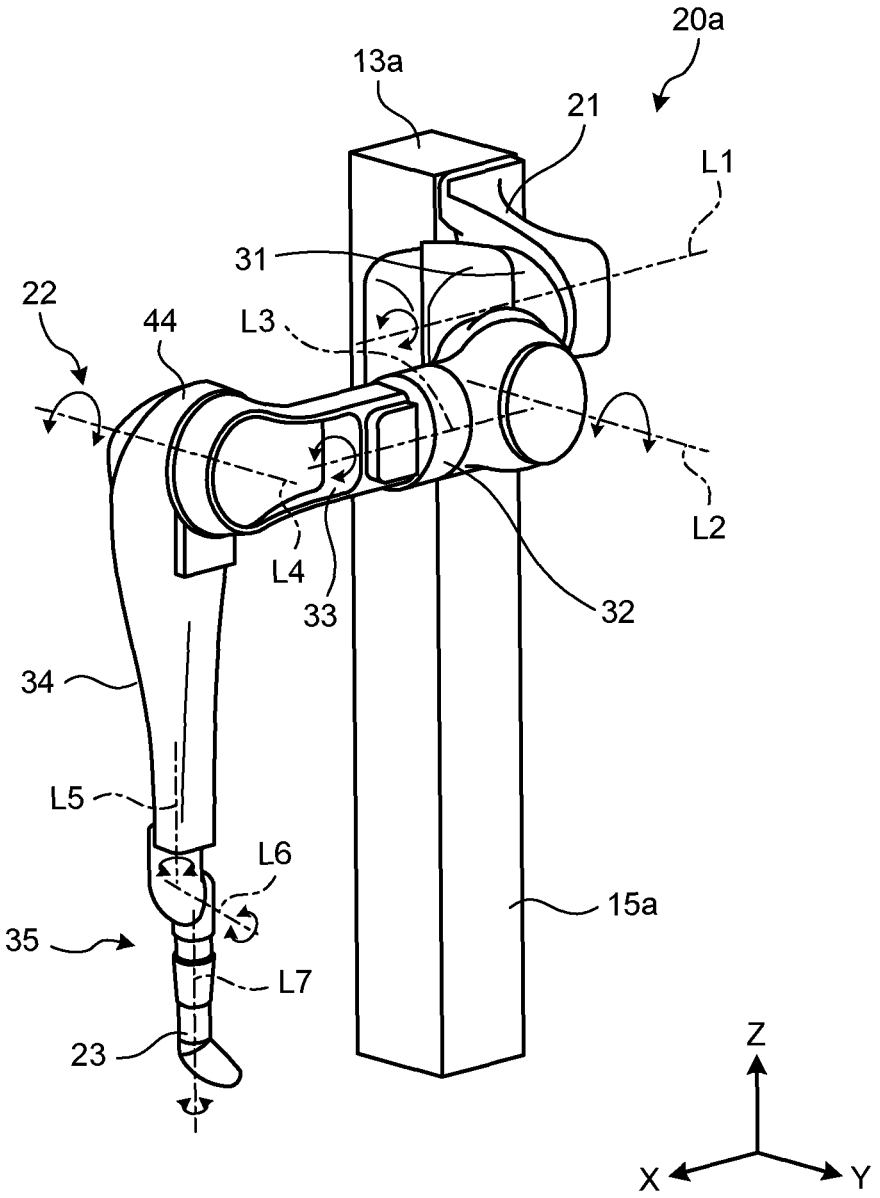
FIG. 2 is an appearance schematic view of a painting robot according to the first embodiment.

Next, the configuration of each of the painting robots 20*a* and 20*b* will be specifically explained. Because the painting robot 20*b* is mirror symmetrical to the painting robot 20*a*, the configuration of the painting robot 20*a* is mainly explained below. FIG. 2 is an appearance schematic view of the painting robot 20*a*. The painting robot 20*a* is provided with a tube 38 (see FIG. 3) that supplies fluid to the painting gun 23, however, in the following, the tube 38 is omitted except in FIG. 3 which will be described later.

As described above, the painting robot 20*a* includes the base portion 21, the arm portion 22, and the painting gun 23. As shown in FIG. 2, the base portion 21 is fixed to a support surface 15*a* of the left support post 13*a*. Moreover, the arm portion 22 includes a rotation base portion 31, a first arm 32, a second arm 33, a third arm 34, and a wrist portion 35.

The rotation base portion 31 is supported by the base portion 21 to be rotatable about a first axis L1, which is parallel to the conveying direction (X-axis direction) of the conveyor line 50, as a central axis. The first arm 32 is supported by the rotation base portion 31 to be rotatable about a second axis L2, which is skew and perpendicular to the first axis L1, as a central axis. In this manner, because the second axis L2 is skew and perpendicular to the first axis L1, the arm portion 22 can be made long compared with the case where the second axis L2 is perpendicular to and intersects with the first axis L1. The second axis L2 may be perpendicular to and intersect with the first axis L1.

The second arm 33 is supported by the first arm 32 to be rotatable about a third axis L3, which is perpendicular to the second axis L2, as a central axis. The third arm 34 is supported by the second arm 33 to be rotatable about a fourth axis L4, which is perpendicular to the third axis L3, as a central axis. A joint portion 44 forming the fourth axis L4 is formed of an area including the tip portion of the second arm 33 and the base end portion of the third arm 34.

The wrist portion 35 is composed of totally three axes from a fifth axis L5 to a seventh axis L7 and the base end thereof is rotatably supported by the tip of the third arm 34. The painting gun 23 is attached to the tip of the wrist portion 35 and paint is sprayed from the painting gun 23.

Air is used for driving the painting gun 23 and thinner or the like is used for cleaning the painting gun 23. Therefore, the painting robot 20*a* is provided with the tube 38 (see FIG. 3) for supplying fluid, such as air and thinner, to the painting gun 23. The tube 38 stores a pipe for supplying air to the painting gun 23, a pipe for supplying thinner to the painting gun 23, and the like.

Figure 3:
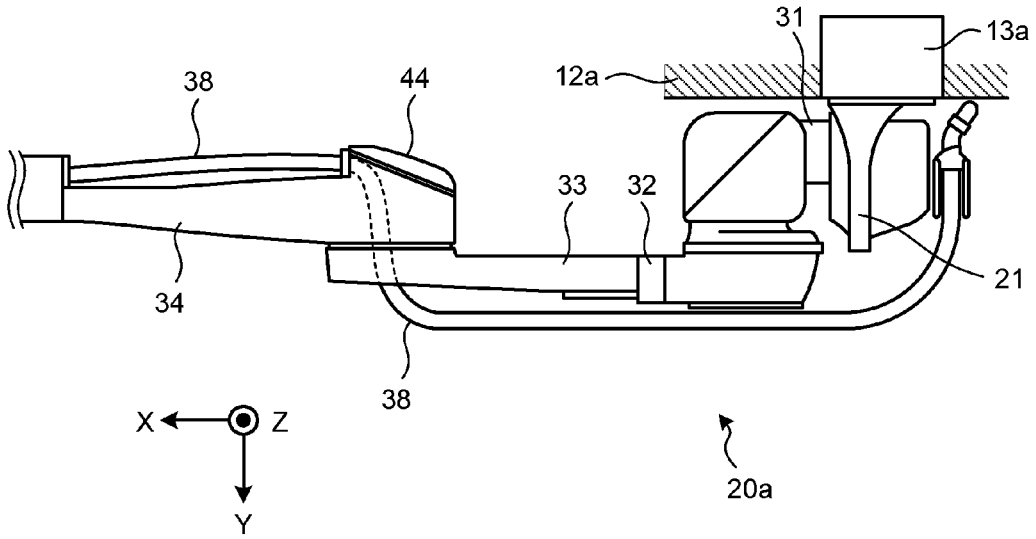
FIG. 3 is a schematic diagram illustrating arrangement of a tube according to the first embodiment.

FIG. 3 is a schematic diagram illustrating arrangement of the tube 38. FIG. 3 illustrates a state where the third arm 34 is set to an approximately horizontal state by rotating the fourth axis L4 from the state shown in FIG. 2. In the following, for convenience sake of explanation, in each of the arms 32 to 34 in the posture as shown in FIG. 3, the side surface opposite to the left sidewall 12*a* is defined as a left side surface and the side surface opposite to the right sidewall 12*b* is defined as a right side surface.

As shown in FIG. 3, the tube 38 is allocated along the right side surfaces of the first and second arms 32 and 33 from the rotation base portion 31. Furthermore, the tube 38 enters the second arm 33 from the right side surface side of the second arm 33 at a position of the fourth axis L4, exits from the left side surface side of the third arm 34, and changes its direction to a direction along the left side surface of the third arm 34. Then, the tube 38 is allocated to reach the wrist portion 35 along the left side surface of the third arm 34.

In the joint portion 44 forming the fourth axis L4, a speed reducer having a hollow portion at a position of a rotation axis is provided and a through passage, which does not inhibit airtightness of the airtight chamber in the joint portion 44, is formed in the hollow portion of the speed reducer. The airtightness of the airtight chamber, in which a motor is arranged, can be ensured by allocating the tube 38 in the through passage.

That means that although a hazardous environment is created in the painting booth 10 due to spraying of paint from the painting gun 23, the airtightness of the airtight chamber in the joint portion 44 is ensured so as not to expose a motor and the like in the joint portion 44 to the dangerous ambience. For example, non-explosive gas is sent from the outside to the airtight chamber in the joint portion 44 to maintain the atmosphere in the airtight chamber to be the same as the atmosphere outside the painting booth 10.

Moreover, because the tube 38 is a part that is damaged easily compared with the arm portion 22 or the like, the tube 38 is arranged at a position away from the object 2. Specifically, in the painting robot 20*a*, as described above, the tube 38 is allocated to the third arm 34 along the left side surface of the third arm 34 closest to the object 2 in a state where the painting robot 20*a* is in a reference posture among the first arm 32 to the third arm 34. Consequently, the tube 38 can be prevented from coming into contact with the object 2 and the like.

The reference posture of the painting robot 20*a* will be explained. The reference posture of the painting robot 20*a* is a standby posture of the painting robot 20*a* and is controlled by the control device 60*a*.

The reference posture of the painting robot 20*a* is a posture shown in FIG. 2. Specifically, when the posture of the painting robot 20*a* is the reference posture, the first arm 32 is cantilevered to the rotation base portion 31 in a state where the first arm 32 is positioned on the right side (positive direction of the X axis) of the rotation base portion 31 and the second arm 33 is cantilevered to the first arm 32 in a state where the second arm 33 is positioned on the object 2 side (positive side of the X axis) of the first arm 32 in the front-back direction (X-axis direction).

When the posture of the painting robot 20*a* is the reference posture, the third arm 34 is cantilevered to the second arm 33 in a state where the third arm 34 is positioned on the left sidewall 12*a* side of the second arm 33.

Figure 4:
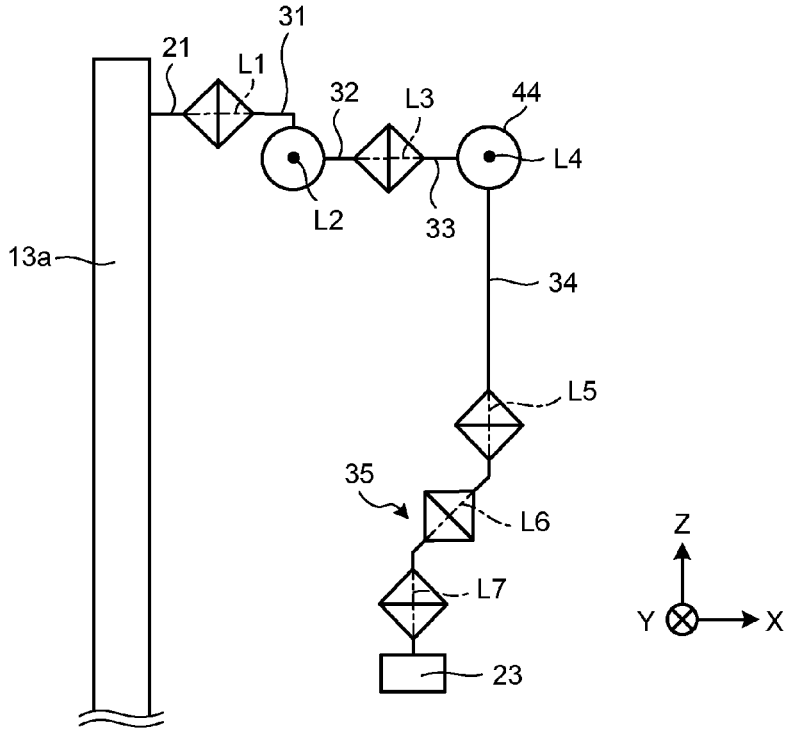
FIG. 4 is a diagram illustrating an axis configuration of the painting robot according to the first embodiment.

Moreover, when the posture of the painting robot 20*a* is the reference posture, as shown in FIG. 4, the second axis L2 and the fourth axis L4 are horizontally located and the third arm 34 is direct to the vertical direction (negative direction of the Z axis). Moreover, the fifth axis L5 and the seventh axis L7 are positioned in the vertical direction (negative direction of the Z axis). FIG. 4 is a diagram illustrating an axis configuration of the painting robot 20*a*.

As described above, in order to reduce the size of the painting booth 10, the base portion 21 of the painting robot 20*a* is fixed on the left sidewall 12*a* side at a position higher than the object 2, and moreover, the painting robot 20*a* includes the arm portion 22 having a seven-axis configuration, which enables further reduction in size of the painting booth 10.

Figure 5A:
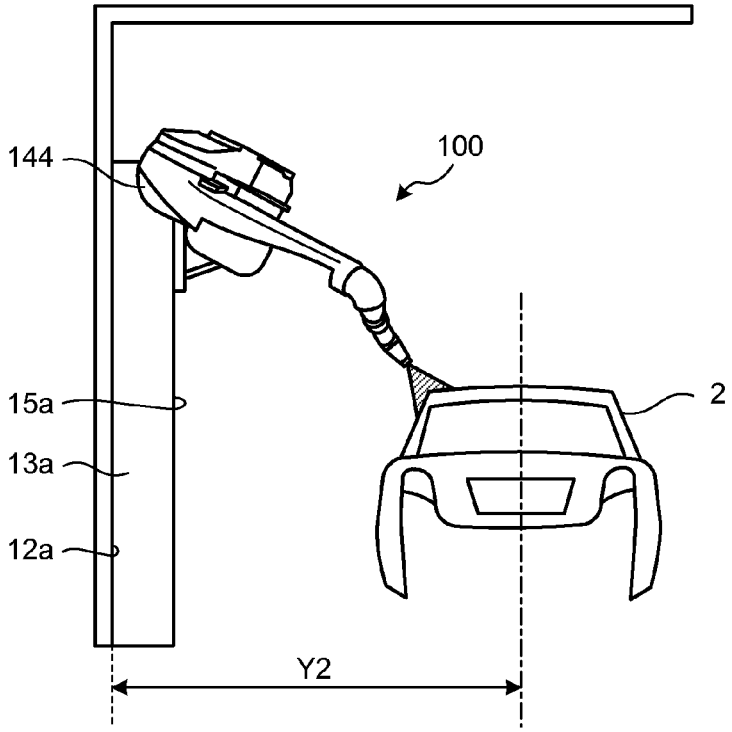
FIG. 5A, FIG. 6A, FIG. 7A, FIG. 8A, FIG. 9A, and FIG. 10A are diagrams illustrating posture examples of a painting robot having a six-axis configuration.

FIG. 5A to FIG. 7B are diagrams illustrating posture examples of the painting robot. FIG. 5A and FIG. 5B illustrate examples of a case of painting an outer panel of a vehicle body as the object 2, and FIGS. 6A and 6B and FIGS. 7A and 7B illustrate a case of painting an inner panel of a vehicle body as the object 2. A painting robot 100 shown in FIG. 5A, FIG. 6A, and FIG. 7A includes an arm portion having a six-axis configuration with no axis corresponding to the third axis L3 of the painting robot 20*a*. Moreover, in the painting robot 100, a joint portion 144 is a portion corresponding to the joint portion 44 forming the fourth axis L4 of the painting robot 20*a*.

Figure 6A:
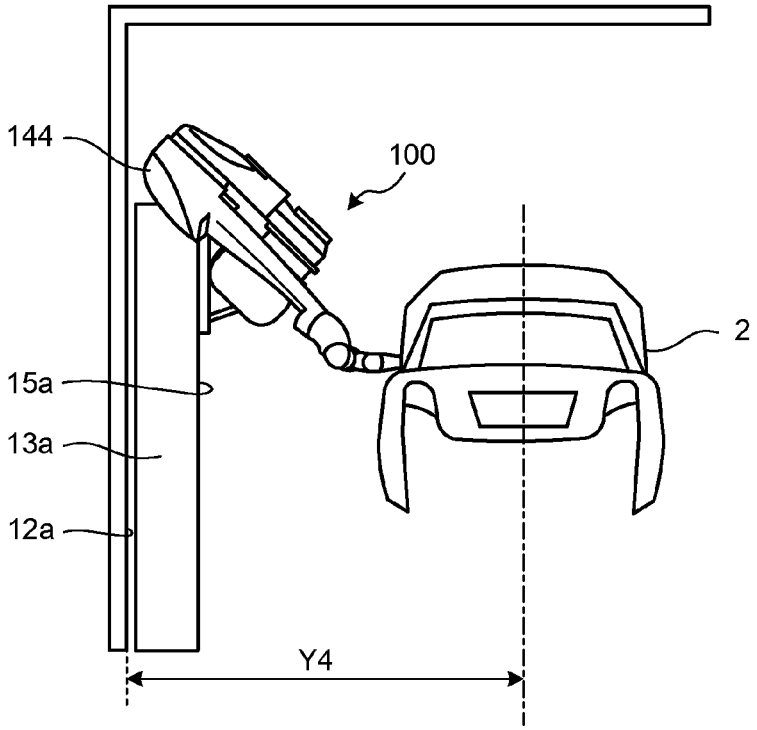
Figure 7A:
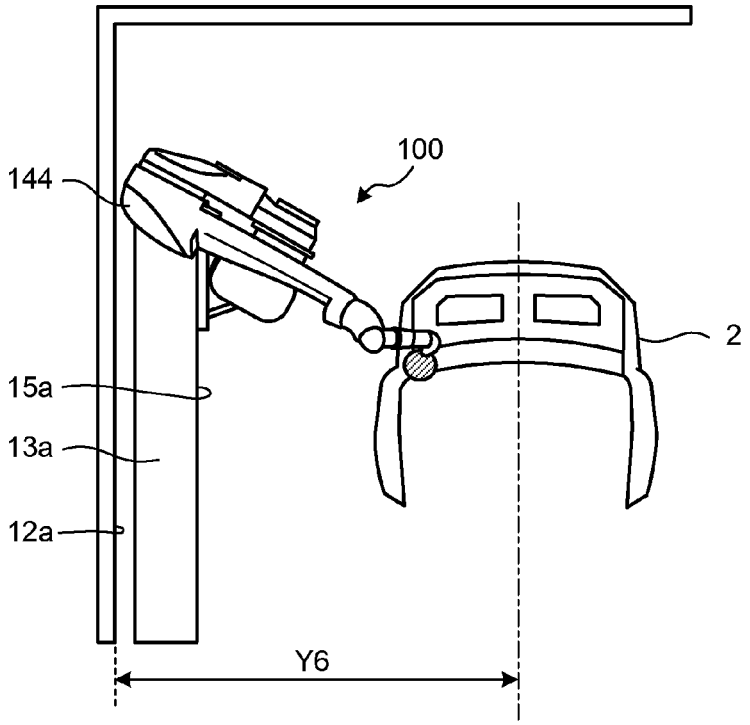

As shown in FIG. 5A, FIG. 6A, and FIG. 7A, in the painting robot 100 having a six-axis configuration, when painting the object 2, the joint portion 144 cannot be positioned on the object 2 side of the support surface 15*a* of the left support post 13*a*, which is a fixing surface of the base portion 21, in some cases. Therefore, the left sidewall 12*a* is arranged on the left side of the support surface 15*a* of the left support post 13*a* that supports the painting robot 100.

Figure 5B:
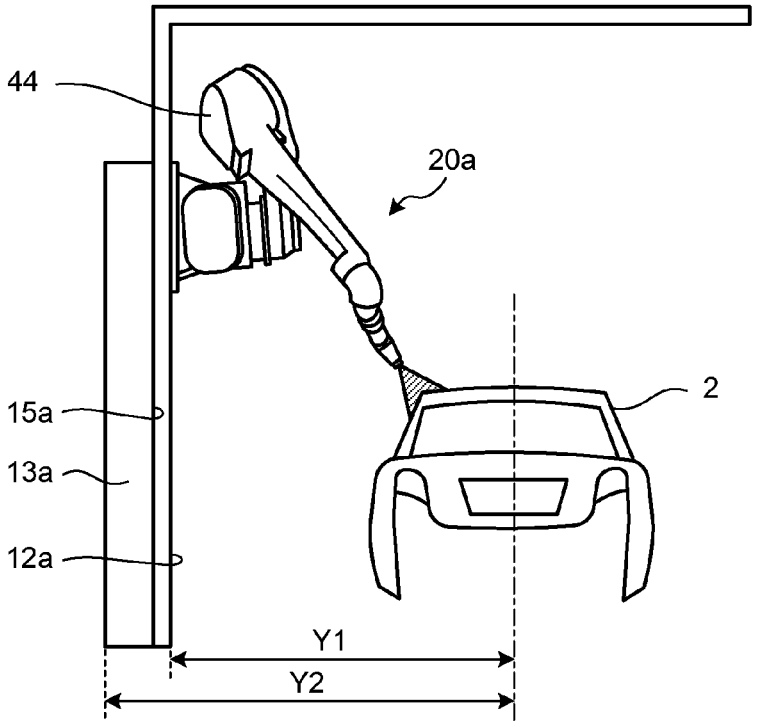
FIG. 5B, FIG. 6B, FIG. 7B, FIG. 8B, FIG. 9B, and FIG. 10B are diagrams illustrating posture examples of the painting robot according to the first embodiment.
Figure 6B:
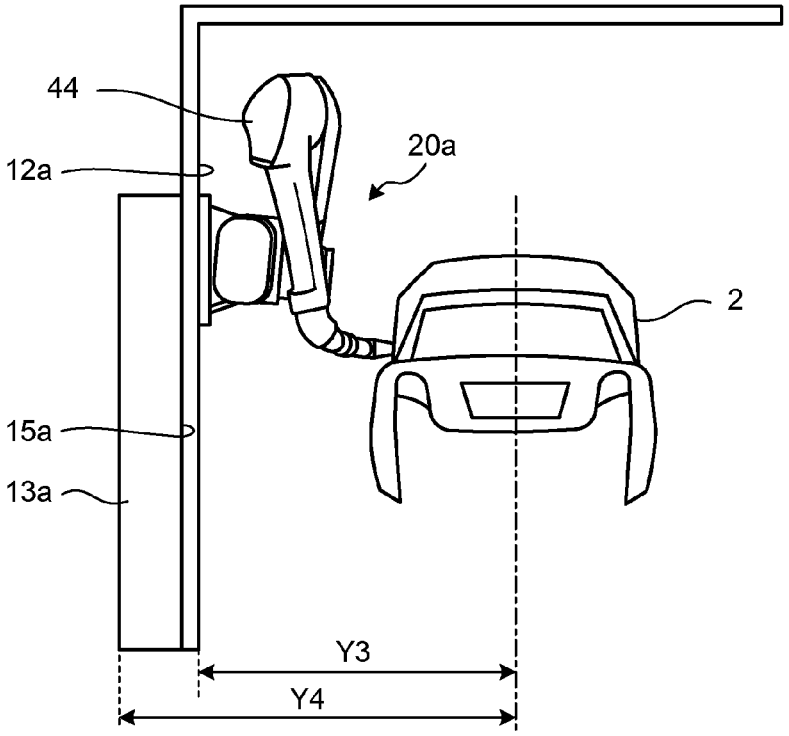
Figure 7B:
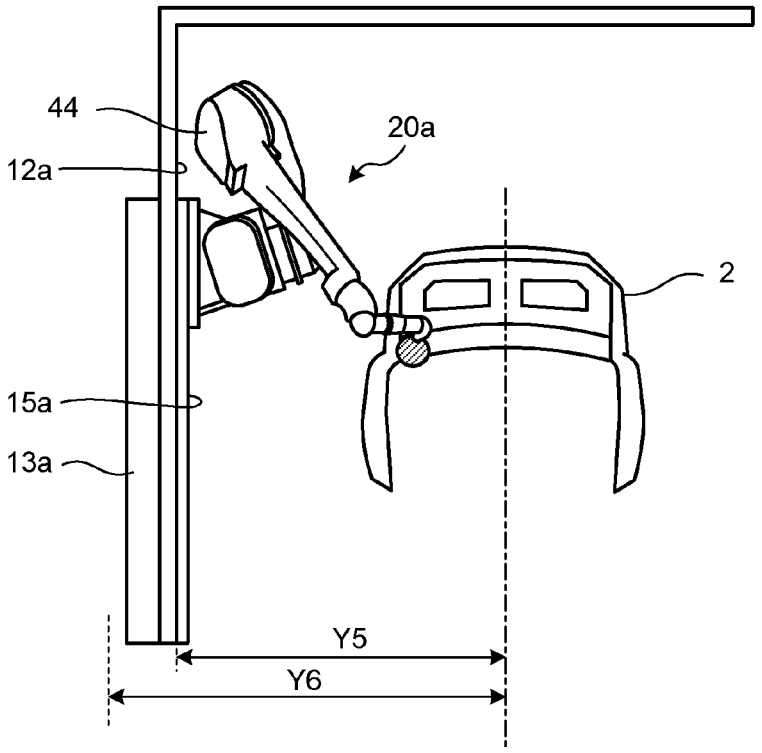

On the other hand, in the painting robot 20*a* having a seven-axis configuration, the joint portion 44 can be positioned on the object 2 side of the support surface 15*a* of the left support post 13*a* by driving one or more axes including the third axis L3. Specifically, in the painting robot 20*a*, in the case where the joint portion 44 moves to a position on the left sidewall 12*a* side of the support surface 15*a* by driving the first axis L1 and the second axis L2 in a state where the rotational position of the third axis L3 is maintained, the third axis L3 is driven by the control device 60*a* before the joint portion 44 moves to a position on the left sidewall 12*a* side of the support surface 15*a*. Therefore, as shown in FIG. 5B, FIG. 6B, and FIG. 7B, the joint portion 44 forming the fourth axis L4 can be positioned on the object 2 side of the support surface 15*a* of the left support post 13*a*.

In this manner, the width of the painting booth 10 can be made small by using the painting robot 20*a* having a seven-axis configuration. Specifically, in the examples shown in FIG. 5B, FIG. 6B, and FIG. 7B, the distance between the left sidewall 12*a* and the center of the vehicle body can be shortened by (Y2−Y1), (Y4−Y3), and (Y6−Y5) compared with the examples shown in FIG. 5A, FIG. 6A, and FIG. 7A, respectively.

Figure 8A:
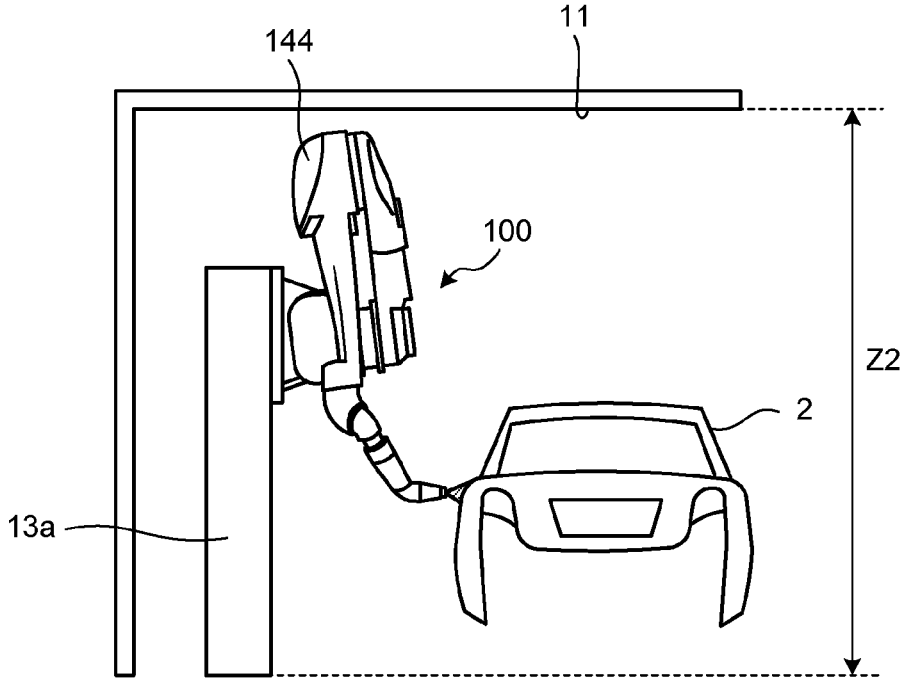
Figure 8B:
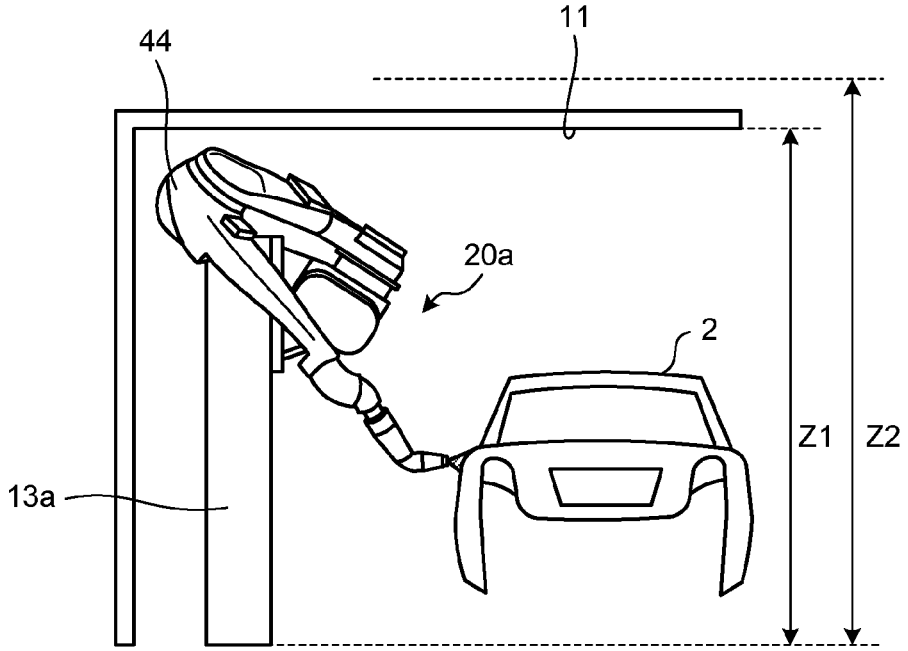
Figure 9A:
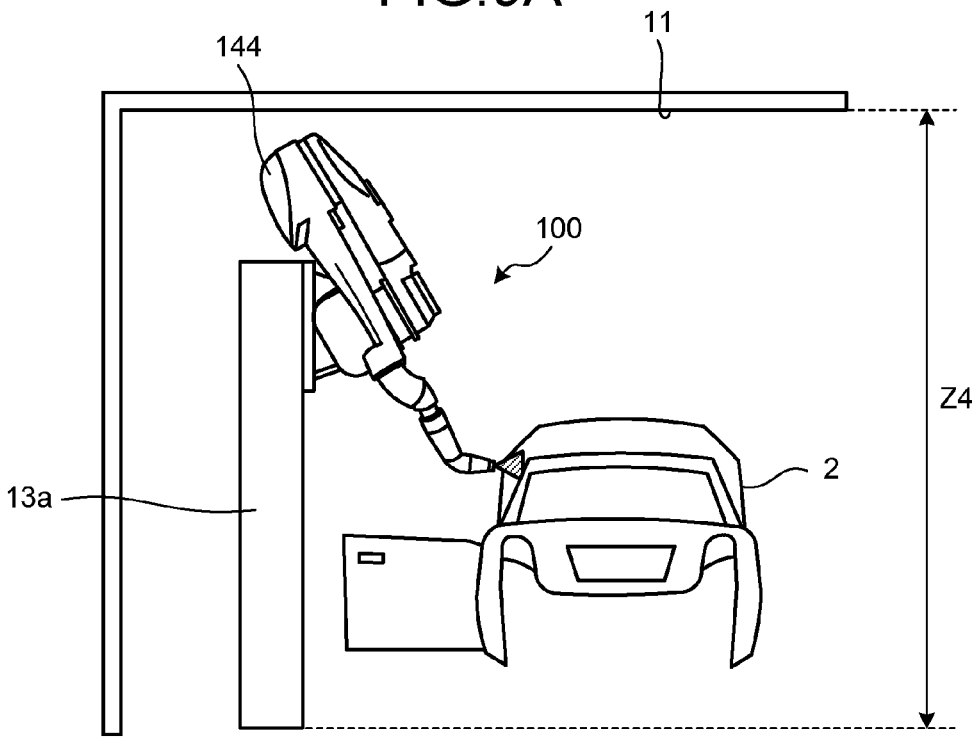
Figure 9B:
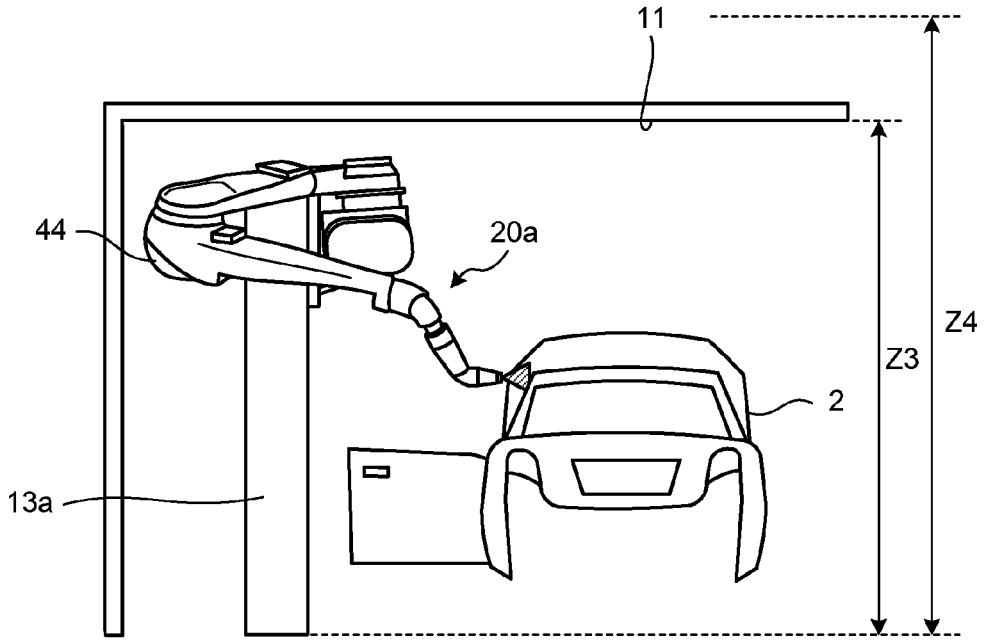

Moreover, the height of the painting booth 10 can be reduced by using the painting robot 20*a* compared with the case of using the painting robot 100. FIG. 8A and FIG. 9A are diagrams illustrating posture examples of the painting robot 100, and FIG. 8B and FIG. 9B are diagrams illustrating posture examples of the painting robot 20*a*. FIG. 8A and FIG. 8B illustrate examples of a case of painting an outer panel of a vehicle body as the object 2 and FIG. 9A and FIG. 9B illustrate examples of a case of painting an inner panel of a vehicle body as the object 2.

As shown in FIG. 8A and FIG. 9A, in the painting robot 100 having a six-axis configuration, when painting the object 2, the joint portion 144 cannot be moved to a low position in some cases. On the other hand, in the painting robot 20*a* having a seven-axis configuration, the joint portion 44 can be moved to a low position by driving one or more axes including the third axis L3. Specifically, in the painting robot 20*a*, in the case where the joint portion 44 moves to a position higher than the ceiling 11 by driving the first axis L1 and the second axis L2 in a state where the rotational position of the third axis L3 is maintained, the third axis L3 is driven by the control device 60*a* before the joint portion 44 moves to a position higher than the ceiling 11. Consequently, in the painting robot 20*a*, as shown in FIG. 8B and FIG. 9B, the joint portion 44 can be moved to a position lower than the case of the painting robot 100.

In this manner, the height of the painting booth 10 can be reduced by using the painting robot 20*a* having a seven-axis configuration. Specifically, in the examples shown in FIG. 8B and FIG. 9B, the distance between the floor of the painting booth 10 and the ceiling 11 can be shortened by (Z2−Z1) and (Z4−Z3) compared with the examples shown in FIG. 8A and FIG. 9A, respectively.

Figure 10A:
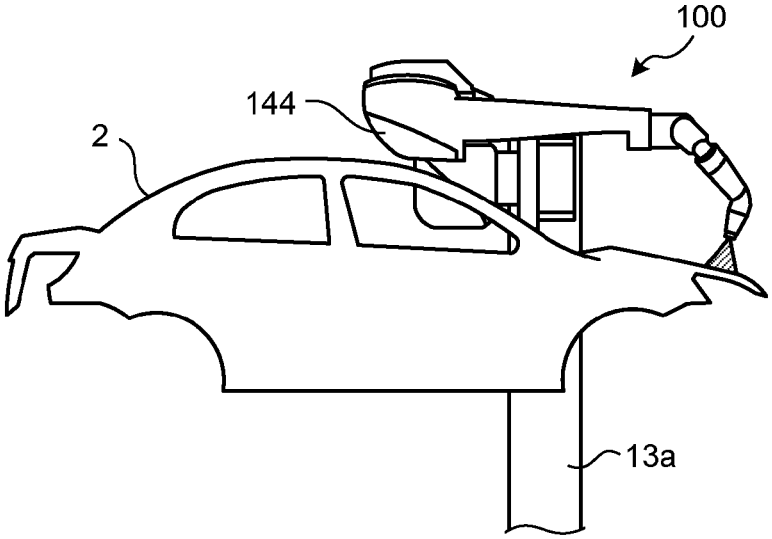
Figure 10B:
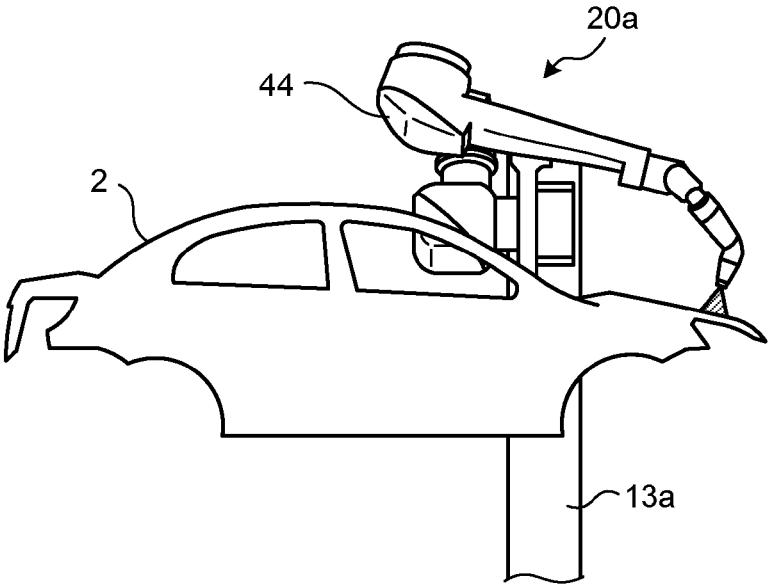

Moreover, the distance from the object 2 can be increased by using the painting robot 20*a* compared with the case of using the painting robot 100. FIG. 10A is a diagram illustrating a posture example of the painting robot 100 and FIG. 10B is a diagram illustrating a posture example of the painting robot 20*a*. FIG. 10A and FIG. 10B illustrate examples of a case of painting an outer panel of a vehicle body as the object 2.

As shown in FIG. 10A, in the painting robot 100 having a six-axis configuration, when painting the object 2, the joint portion 144 approaches the object 2 and the joint portion 144 comes into contact with the object 2 in some cases. On the other hand, in the painting robot 20*a* having a seven-axis configuration, the joint portion 44 can be moved to a position equal to or higher than the height of the object 2 by driving one or more axes including the third axis L3. Specifically, in the painting robot 20*a*, in the case where the joint portion 44 moves to a position lower than the height of the object 2 by driving the first axis L1 and the second axis L2 in a state where the rotational position of the third axis L3 is maintained, the third axis L3 is driven by the control device 60*a* before the joint portion 44 moves to a position lower than the height of the object 2. Consequently, as shown in FIG. 10B, the joint portion 44 can be moved to a position equal to or higher than the height of the object 2.

Figure 11:
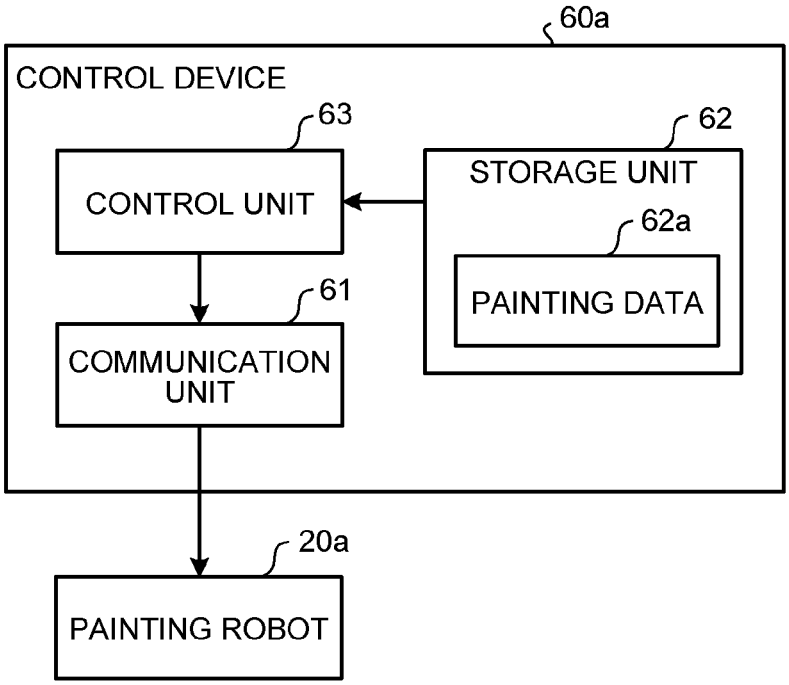
FIG. 11 is a diagram illustrating a configuration of a control device according to the first embodiment.

The driving method of the painting robots 20*a* and 20*b* by the control devices 60*a* and 60*b* will be specifically explained with reference to the drawings. In the following, the configuration of the control devices 60*a* and 60*b* will be explained first, and then the specific example of the driving method of the painting robots 20*a* and 20*b* will be explained. FIG. 11 is a diagram illustrating the configuration of the control device 60*a*. Because the control device 60*b* has a configuration similar to the control device 60*a*, the configuration of the control device 60*a* will be explained here.

As shown in FIG. 11, the control device 60*a* includes a communication unit 61, a storage unit 62, and a control unit 63. The communication unit 61 is a communication device, such as a LAN board, that performs transmission and reception of data between the painting robot 20*a* and the control device 60*a*. The communication unit 61, for example, performs processing of transmitting an operating instruction received from the control unit 63 to the painting robot 20*a*.

The storage unit 62 stores therein painting data 62*a*. The painting data 62*a* includes interpolation operation data, adjustment operation data, and movement operation data. The interpolation operation data is control data on the arm portion 22 used when spraying paint from the painting gun 23. Specifically, the interpolation operation data is data for controlling the arm portion 22 to move the tip of the arm portion 22 in the vertical direction at a constant speed during the period from the start to the end of the spraying of paint from the painting gun 23. The painting data 62*a* further includes control data for controlling spraying of the paint by the painting gun 23 and the like.

The control unit 63 performs overall control of the control device 60*a*. The control unit 63 reads the interpolation operation data, the adjustment operation data, and the movement operation data included in the painting data 62*a* from the storage unit 62 and causes the communication unit 61 to output an operating instruction to the arm portion 22 to the painting robot 20*a* on the basis of the data. When the operating instruction to the arm portion 22 is received from the control device 60*a*, the painting robot 20*a* drives an axis corresponding to the received operating instruction among the first axis L1 to the seventh axis L7 by the rotation amount corresponding to the operating instruction.

Figure 12:
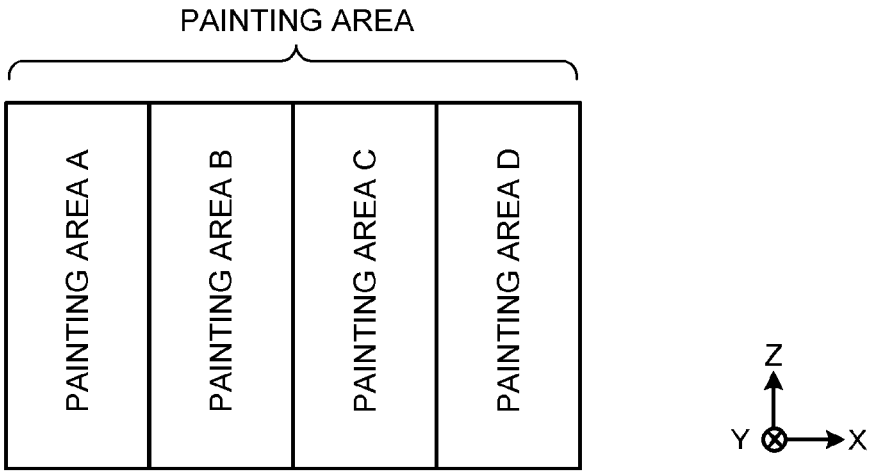
FIG. 12 and FIG. 13 are explanatory diagrams of a control method of the painting robot by the control device according to the first embodiment.
Figure 13:
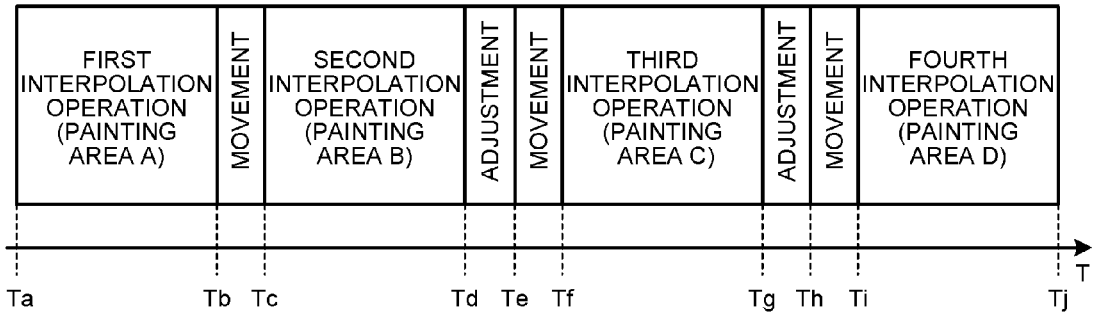

The control method of the painting robot 20*a* by the control device 60*a* on the basis of the interpolation operation data, the adjustment operation data, and the movement operation data will be specifically explained. FIG. 12 and FIG. 13 are explanatory diagrams of the control method of the painting robot 20*a* by the control device 60*a*. The control method of the painting robot 20*b* by the control device 60*b* is similar to the control method of the painting robot 20*a* by the control device 60*a*.

As shown in FIG. 12, the object 2 has painting areas A to D as painting areas to be painted. The painting areas A to D are painted in the vertical direction (Z-axis direction) as a painting direction in the order of the painting area A, the painting area B, the painting area C, and the painting area D.

In this case, the painting data 62*a* includes first interpolation operation data, second interpolation operation data, third interpolation operation data, and fourth interpolation operation data. The first interpolation operation data is data for generating an operating instruction to cause the painting robot 20*a* to perform a first interpolation operation. The first interpolation operation is an operation of the arm portion 22 to move the tip of the painting gun 23 in the vertical direction along the painting area A at a constant speed. The second interpolation operation data is data for generating an operating instruction to cause the painting robot 20*a* to perform a second interpolation operation. The second interpolation operation is an operation of the arm portion 22 to move the tip of the painting gun 23 in the vertical direction along the painting area B at a constant speed.

Moreover, the third interpolation operation data is data for generating an operating instruction to cause the painting robot 20*a* to perform a third interpolation operation. The third interpolation operation is an operation of the arm portion 22 to move the tip of the painting gun 23 in the vertical direction along the painting area C at a constant speed. The fourth interpolation operation data is data for generating an operating instruction to cause the painting robot 20*a* to perform a fourth interpolation operation. The fourth interpolation operation is an operation of the arm portion 22 to move the tip of the painting gun 23 in the vertical direction along the painting area D at a constant speed.

In the firth interpolation operation, the second interpolation operation, and the fourth interpolation operation, when the first axis L1 and the second axis L2 of the arm portion 22 are driven in a state where the rotational position of the third axis L3 is a rotational position (hereinafter, described as a reference rotational position) in the above-described reference posture, the joint portion 44 does not hit the left sidewall 12*a*, the ceiling 11, and the object 2. On the other hand, in the third interpolation operation, when the first axis L1 and the second axis L2 of the arm portion 22 are driven in a state where the rotational position of the third axis L3 is the reference rotational position, the joint portion 44 hits the left sidewall 12*a*, the ceiling 11, or the object 2.

The control unit 63 first causes the painting robot 20*a* to perform the first interpolation operation of moving the tip of the painting gun 23 in the vertical direction at a constant speed by causing the communication unit 61 to output an operating instruction based on the first interpolation operation data to the painting robot 20*a* (see time Ta to Tb shown in FIG. 13).

In the first interpolation operation, in the painting robot 20*a*, the axes L1, L2, and L4 to L7 excluding the third axis L3 are driven in a state where the rotational position of the third axis L3 is maintained at the reference rotational position, and the tip of the painting gun 23 moves in the vertical direction at a constant speed. The control unit 63 controls the painting gun 23 during the first interpolation operation to spray paint from the painting gun 23, thereby performing painting on the painting area A.

When the first interpolation operation is finished, the control unit 63 causes the communication unit 61 to output an operating instruction based on the movement operation data to the painting robot 20*a*. Consequently, the arm portion 22 is driven to set the spraying gun 23 to the position and posture to start the second interpolation operation in a state where the rotational position of the third axis L3 is maintained at the reference rotational position (time Tb to Tc shown in FIG. 13).

Thereafter, the control unit 63 causes the painting robot 20*a* to perform the second interpolation operation of moving the tip of the painting gun 23 in the vertical direction at a constant speed by causing the communication unit 61 to output an operating instruction based on the second interpolation operation data to the painting robot 20*a* (see time Tc to Td shown in FIG. 13). In the second interpolation operation, in the painting robot 20*a*, in the similar manner to the first interpolation operation, the axes L1, L2, and L4 to L7 excluding the third axis L3 are driven in a state where the rotational position of the third axis L3 is maintained at the reference rotational position, thereby moving the tip of the painting gun 23 in the vertical direction at a constant speed. During the second interpolation operation, the control unit 63 controls the painting gun 23 to spray paint from the painting gun 23, thereby performing painting on the painting area B.

When the second interpolation operation is finished, the control unit 63 causes the communication unit 61 to output an operating instruction based on the adjustment operation data to the painting robot 20*a*. Consequently, after the operation of the painting robot 20*a* is temporarily stopped, one or more axes including the third axis L3 are driven so that the joint portion 44 is positioned not to hit the left sidewall 12*a*, the ceiling 11, and the object 2 during execution of the third interpolation operation (time Td to Te shown in FIG. 13).

Next, the control unit 63 causes the communication unit 61 to output an operating instruction based on the movement operation data to the painting robot 20*a*. Consequently, the arm portion 22 is driven to set the painting gun 23 to the position and posture to start the third interpolation operation in a state where the rotational position of the third axis L3 is maintained at a position adjusted by the above-described adjustment operation (time Te to Tf shown in FIG. 13).

Thereafter, the control unit 63 causes the painting robot 20*a* to perform the third interpolation operation of moving the tip of the painting gun 23 in the vertical direction at a constant speed by causing the communication unit 61 to output an operating instruction based on the third interpolation operation data to the painting robot 20*a* (see time Tf to Tg shown in FIG. 13). During the third interpolation operation, the control unit 63 controls the painting gun 23 to spray paint from the painting gun 23, thereby performing painting on the painting area C.

The rotational position of the third axis L3 is moved from the reference rotational position by the instruction based on the above-described adjustment operation data, thereby avoiding the joint portion 44 from hitting the left sidewall 12*a*, the ceiling 11, and the object 2 in the third interpolation operation.

In other words, as described above, in the third interpolation operation, if the arm portion 22 is driven in a state where the rotational position of the third axis L3 is maintained at the reference rotational position, the position of the joint portion 44 forming the fourth axis L4 falls outside a range (hereinafter, described as a predetermined range V) in which the joint portion 44 does not come into contact with an obstacle, such as the left sidewall 12*a*, the ceiling 11, and the object 2.

Thus, the control device 60*a* keeps the position of the joint portion 44 within the predetermined range V in the third interpolation operation by driving one or more axes including the third axis L3 before the third interpolation operation in which the position of the joint portion 44 falls outside the predetermined range V when the rotational position of the third axis L3 is the reference rotational position. Moreover, in the third interpolation operation, because the rotational position of the third axis L3 is fixed in the similar manner to the first interpolation operation, the control unit 63 controls six axes, therefore control over the arm portion 22 can be prevented from being complicated.

When the third interpolation operation is finished, the control unit 63 causes the communication unit 61 to output an operating instruction based on the adjustment operation data to the painting robot 20*a*. Consequently, the rotational position of the third axis L3 is returned to the reference rotational position (time Tg to Th shown in FIG. 13).

In this manner, after the second interpolation operation is completed, the control device 60*a* temporarily stops the painting robot 20*a* and drives the third axis L3 before performing the third interpolation operation, and thereafter, causes the painting robot 20*a* to perform the third interpolation operation. Then, after the third interpolation operation is completed, the control device 60*a* returns the rotational position of the third axis L3 to the reference rotational position and furthermore causes the painting robot 20*a* to perform the fourth interpolation operation. Therefore, in the interpolation operation in which the position of the joint portion 44 falls within the predetermined range V even if the rotational position of the third axis L3 is the reference rotational position, the rotational position of the third axis L3 can be maintained at the reference rotational position, so that the painting data 62*a* can be easily generated.

Next, the control unit 63 causes the communication unit 61 to output an operating instruction based on the movement operation data to the painting robot 20*a*. Consequently, the arm portion 22 is driven to set the painting gun 23 to the position and posture to start the fourth interpolation operation in a state where the rotational position of the third axis L3 is maintained at the reference rotational position (time Th to Ti shown in FIG. 13).

Thereafter, the control unit 63 causes the painting robot 20*a* to perform the fourth interpolation operation of moving the tip of the painting gun 23 in the vertical direction at a constant speed by causing the communication unit 61 to output an operating instruction based on the fourth interpolation operation data to the painting robot 20*a* (see time Ti to Tj shown in FIG. 13). During the fourth interpolation operation, the control unit 63 controls the painting gun 23 to spray paint from the painting gun 23, thereby performing painting on the painting area D.

In this manner, the painting system 1 according to the first embodiment includes the painting booth 10 surrounded by the sidewalls 12*a* and 12*b* and the ceiling 11, the conveyor line 50 that is arranged in the painting booth 10 and conveys the object 2, and the painting robots 20*a* and 20*b* that perform painting on the object 2. The painting robots 20*a* and 20*b* each include the base portion 21 fixed on the sidewall 12*a* or 12*b* side in the painting booth 10 and the arm portion 22 having a seven-axis configuration connected to the base portion 21. Consequently, the size of the painting booth 10 can be reduced.

In the above description, explanation is made for the interpolation operation to the painting areas A to D adjacent to each other in the X-axis direction, however, it is not limited to this. For example, the interpolation operation to the painting areas adjacent to each other in the Z-axis direction or the interpolation operation to the spaced painting areas may be performed.

Moreover, it is explained that the joint portion 44 of the above-described painting robot 20*a* is formed of the area including the tip portion of the second arm 33 and the base end portion of the third arm 34, however, the joint portion 44 formed of the fourth axis L4 may be provided separately from the second arm 33 and the third arm 34 and the joint portion 44 may be connected to the second arm 33 and the third arm 34.

Moreover, in the above description, in the case where the position of the joint portion 44 falls outside the predetermined range V in which the joint portion 44 does not come into contact with an obstacle, such as the left sidewall 12*a*, the ceiling 11, and the object 2, the third axis L3 is driven, however, it is not limited thereto. For example, in the case where the position of the joint portion 44 is restricted to fall within a predetermined range Va smaller than the predetermined range V, if the position of the joint portion 44 falls outside the predetermined range Va, the third axis L3 may be driven.

Second Embodiment

Figure 14:
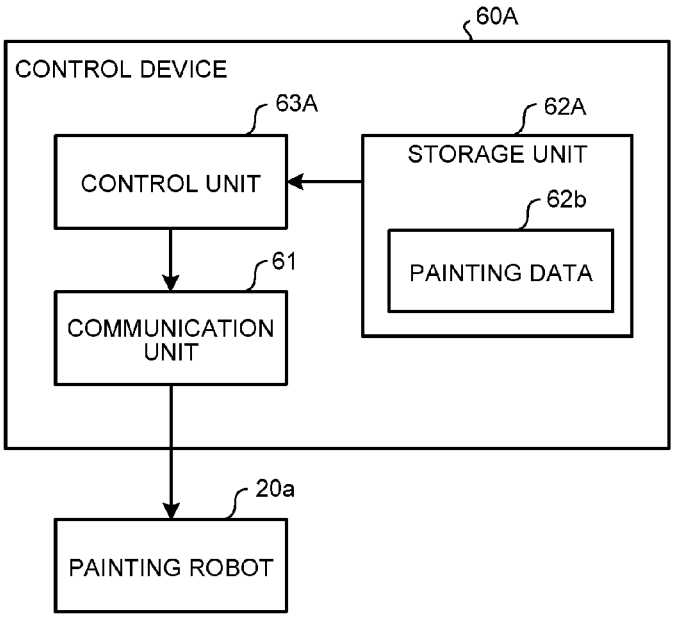
FIG. 14 is a diagram illustrating a configuration of a control device according to a second embodiment.

Next, a painting system according to the second embodiment will be explained. The painting system according to the second embodiment is different from the painting system 1 according to the first embodiment in the point that a control unit of a control device determines whether to drive the third axis L3 in the arm portion 22. FIG. 14 is a diagram illustrating a configuration of a control device 60A according to the second embodiment. In the following, for easy understanding of the explanation, the configuration similar to the control device 60*a* in the painting system 1 according to the first embodiment is denoted by the same reference numeral. In the present embodiment, the control device 60A that controls the painting robot 20*a* is explained, however, a not-shown control device that controls the painting robot 20*b* has a configuration same as the control device 60A.

As shown in FIG. 14A, the control device 60A includes the communication unit 61, a storage unit 62A, and a control unit 63A. The storage unit 62A stores therein painting data 62*b*. The painting data 62*b* is data similar to the painting data 62*a* except the adjustment operation data. In other words, the painting data 62*b* includes the first interpolation operation data, the second interpolation operation data, the third interpolation operation data, the fourth interpolation operation data, and the movement operation data.

The control unit 63A performs overall control of the control device 60A. The control unit 63A reads the painting data 62*b* from the storage unit 62A and causes the communication unit 61 to output an operating instruction to the arm portion 22 to the painting robot 20*a* on the basis of the painting data 62*b*.

Figure 15:
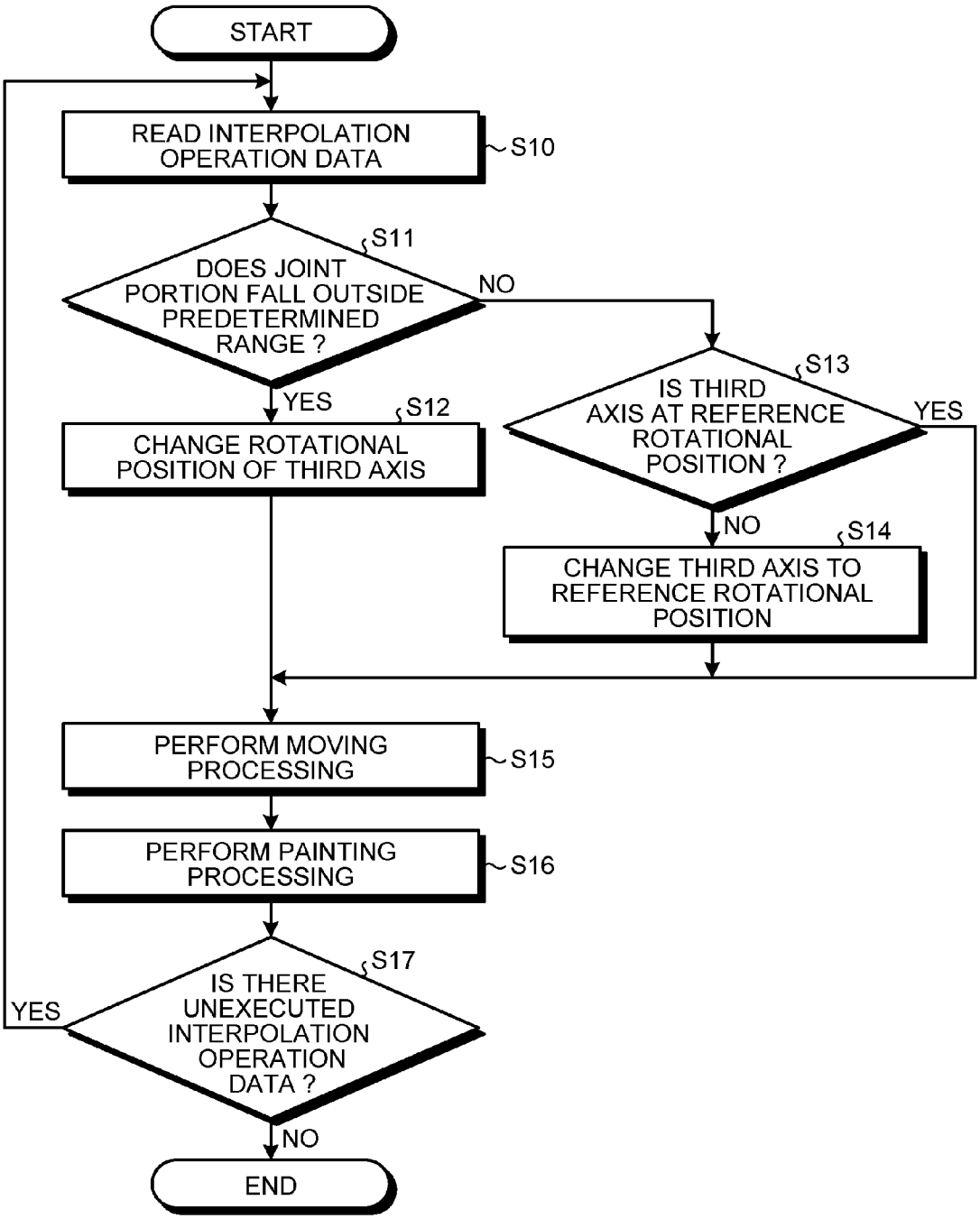
FIG. 15 is a flowchart illustrating a processing procedure performed by the control device according to the second embodiment.

Next, the processing procedure performed by the control device 60A shown in FIG. 14 will be explained with reference to FIG. 15. FIG. 15 is a flowchart illustrating the processing procedure performed by the control device 60A according to the second embodiment.

As shown in FIG. 15, the control unit 63A reads the interpolation operation data in the painting data 62*b* corresponding to the interpolation operation to be performed next from the storage unit 62A (Step S10). For example, when the execution of the first interpolation operation is completed in the painting robot 20*a*, the second interpolation operation data is read.

Next, in the interpolation operation to be performed next, the control unit 63A determines whether the position of the joint portion 44 formed of the fourth axis L4 falls outside a predetermined range W (Step S11). For example, when the interpolation operation to be performed next is the second interpolation operation, the control unit 63A determines that the position of the joint portion 44 does not fall outside the predetermined range W, and, on the other hand, when the interpolation operation to be performed next is the third interpolation operation, the control unit 63A determines that the position of the joint portion 44 falls outside the predetermined range W. The "predetermined range W" is, for example, a range in which the joint portion 44 does not come into contact with an obstacle, such as the painting booth 10 and the object 2.

When the control unit 63A determines that the position of the joint portion 44 falls outside the predetermined range W in the interpolation operation to be performed next (Yes in Step S11), the control unit 63A does not output an operating instruction to the painting robot 20*a* and temporarily stops the operation of the painting robot 20*a*. Thereafter, the control unit 63A drives one or more axes including the third axis L3 by causing the communication unit 61 to output an operating instruction to set the position of the joint portion 44 to fall within the predetermined range W when performing the interpolation operation to be performed next to the painting robot 20*a* (Step S12).

On the other hand, when the control unit 63A determines that the position of the joint portion 44 does not fall outside the predetermined range W in the interpolation operation to be performed next (No in Step S11), the control unit 63A determines whether the rotational position of the third axis L3 is the reference rotational position (Step S13). When the control unit 63A determines that the rotational position of the third axis L3 is not the reference rotational position (No in Step S13), the control unit 63A returns the rotational position of the third axis L3 to the reference rotational position by causing the communication unit 61 to output an operating instruction based on the adjustment operation data to the painting robot 20*a* (Step S14).

When the processing in Steps S12 and S14 is finished or when it is determined that the rotational position of the third axis L3 is the reference rotational position in Step S13 (Yes in Step S13), the control unit 63A performs moving processing of moving the painting gun 23 attached to the tip of the arm portion 22 to a start position of the interpolation operation to be performed next (Step S15). Specifically, the control unit 63A drives the arm portion 22 by causing the communication unit 61 to output an operating instruction based on the movement operation data read from the storage unit 62A to the painting robot 20*a*.

Next, the control unit 63A performs painting processing of spraying paint from the painting gun 23 while performing the interpolation operation by driving the arm portion 22 (Step S16). Specifically, the control unit 63A drives the arm portion 22 by causing the communication unit 61 to output an operating instruction based on the interpolation operation data read from the storage unit 62A to the painting robot 20*a*. Moreover, the control unit 63A controls the painting gun 23 on the basis of the control data stored in the storage unit 62A to spray paint from the painting gun 23.

When the painting processing is finished in Step S16, the control unit 63A determines whether there is unexecuted interpolation operation data (Step S17). For example, in Step S16, when the painting processing by the fourth interpolation operation is finished, the control unit 63A determines that there is no unexecuted interpolation operation data. On the other hand, when the painting processing by the third interpolation operation is finished in Step S16, there is unexecuted fourth interpolation operation data, therefore the control unit 63A determines that there is unexecuted interpolation operation data.

When the control unit 63A determines that there is unexecuted interpolation operation data (Yes in Step S17), the processing from Step S10 is repeated. On the other hand, when the control unit 63A determines that there is no unexecuted interpolation operation data (No in Step S17), the control unit 63A returns the arm portion 22 to the reference posture by causing the communication unit 61 to output an operating instruction to return the arm portion 22 to the reference posture to the painting robot 20*a* and ends the control of the arm portion 22 and the painting gun 23.

As described above, the control device 60A according to the second embodiment determines whether the position of the joint portion 44 formed of the fourth axis L4 falls outside the predetermined range W in the interpolation operation to be performed next. Then, when the position of the joint portion 44 falls outside the predetermined range W, the control device 60A controls the arm portion 22 to set the position of the joint portion 44 to fall within the predetermined range W in the interpolation operation to be performed next by driving the third axis L3. In the control device 60A, because the painting data 62*b* does not include the adjustment operation data, the painting data 62*b* can be generated easily compared with the control device 60*a* in the first embodiment.

The control device 60A can determine whether the position of the joint portion 44 falls within the predetermined range W, for example, by determining whether the position of the point at which the third axis L3 intersects with the fourth axis L4 falls within a preset range or by determining whether any of the outer surface positions of the joint portion 44 falls within the predetermined range W.

Moreover, although the control device 60A determines whether the position of the joint portion 44 falls within the predetermined range W, the control device 60A may determine whether the position of the joint portion 44 falls within a forbidden area instead of the above determination.

The first and second embodiments described above illustrate examples of controlling each of the painting robots 20*a* and 20*b* by a different control device, however, it is not limited to this and, for example, the two painting robots 20*a* and 20*b* may be controlled by one control device.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A painting system comprising:

a painting booth surrounded by a sidewall and a ceiling;

a conveyor line that is arranged in the painting booth and conveys an object to be painted; and a painting robot that performs painting on the object, wherein the painting robot includes:

a base portion fixed on the sidewall side in the painting booth; and an arm portion that is connected to the base portion and has a seven-axis configuration, the arm portion includes:

a rotation base portion that is supported by the base portion to be rotatable about a first axis which is parallel to a conveying direction of the conveyor line;

a first arm that is supported by the rotation base portion to be rotatable about a second axis which is perpendicular to and intersects with the first axis or is skew and perpendicular to the first axis;

a second arm that is supported by the first arm to be rotatable about a third axis which is perpendicular to the second axis;

a third arm that is supported by the second arm to be rotatable about a fourth axis which is perpendicular to the third axis; and a wrist portion that is rotatably supported by a tip of the third arm and has a three-axis configuration including a fifth axis to a seventh axis, and the arm portion further includes a joint portion forming the fourth axis between the second and third arms, the joint portion approaching the sidewall by rotating the second arm about the third axis wherein the fifth axis and the seventh axis are parallel to and offset from each other when the painting robot is in a reference posture.

2. The painting system according to claim 1, further comprising a control device that controls the painting robot, wherein when causing the painting robot to stand by, the control device sets the painting robot to the reference posture in which the second axis and the fourth axis are horizontally located and the third arm is direct to a vertical direction.

3. The painting system according to claim 2, wherein, in a case where a position of the joint portion forming the fourth axis falls outside a predetermined range by driving the arm portion while maintaining a rotational position of the third axis in the reference posture, the control device drives the third axis to maintain the position of the joint portion within the predetermined range before the position of the joint portion falls outside the predetermined range.

4. The painting system according to claim 3, wherein the control device causes the painting robot to sequentially perform a plurality of interpolation operations to paint the object and drives the third axis during a period from when one interpolation operation is completed to when a next interpolation operation is started.

5. The painting system according to claim 4, wherein, in a case where the position of the joint portion falls outside the predetermined range during execution of the next interpolation operation by maintaining the rotational position of the third axis in the reference posture after the one interpolation operation is completed, the control device drives the third axis after the painting robot is temporarily stopped after the one interpolation operation is completed, returns the third axis to the rotational position of the reference posture after the next interpolation operation is completed, and thereafter, further causes the painting robot to perform a next interpolation operation.

6. The painting system according to claim 4, wherein, in a case where the joint portion moves to a position closer to the sidewall side than a position of a fixing surface of the base portion by driving the first axis and the second axis while maintaining the rotational position of the third axis in the reference posture, the control device drives the third axis to move the joint portion to a position closer to the object side than a position of the fixing surface of the base portion before the joint portion moves to a position closer to the sidewall side than a position of the fixing surface of the base portion.

7. The painting system according to claim 4, wherein, in a case where the joint portion moves to a position higher than a predetermined height by driving the first axis and the second axis while maintaining the rotational position of the third axis in the reference posture, the control device drives the third axis to move the joint portion to a position equal to or lower than the predetermined height before the joint portion moves to a position higher than the predetermined height.

8. The painting system according to claim 4, wherein, in a case where the joint portion moves to a position lower than a height of the object by driving the first axis and the second axis while maintaining the rotational position of the third axis in the reference posture, the control device drives the third axis to move the joint portion to a position equal to or higher than the height of the object before the joint portion moves to a position lower than the height of the object.

9. The painting system according to claim 4, wherein the painting robot in a state of the reference posture is such that the second arm is cantilevered to the first arm in a state where the second arm is positioned on the object side of the first arm, the third arm is supported by the second arm in a state where the third arm is positioned on the sidewall side of the second arm, and a tube that supplies fluid to a painting gun attached to the wrist portion is arranged to the third arm along the sidewall side of the third arm.

10. The painting system according to claim 3, wherein, in a case where the joint portion moves to a position closer to the sidewall side than a position of a fixing surface of the base portion by driving the first axis and the second axis while maintaining the rotational position of the third axis in the reference posture, the control device drives the third axis to move the joint portion to a position closer to the object side than a position of the fixing surface of the base portion before the joint portion moves to a position closer to the sidewall side than a position of the fixing surface of the base portion.

11. The painting system according to claim 3, wherein, in a case where the joint portion moves to a position higher than a predetermined height by driving the first axis and the second axis while maintaining the rotational position of the third axis in the reference posture, the control device drives the third axis to move the joint portion to a position equal to or lower than the predetermined height before the joint portion moves to a position higher than the predetermined height.

12. The painting system according to claim 3, wherein, in a case where the joint portion moves to a position lower than a height of the object by driving the first axis and the second axis while maintaining the rotational position of the third axis in the reference posture, the control device drives the third axis to move the joint portion to a position equal to or higher than the height of the object before the joint portion moves to a position lower than the height of the object.

13. The painting system according to claim 2, wherein the painting robot in a state of the reference posture is such that the second arm is cantilevered to the first arm in a state where the second arm is positioned on the object side of the first arm, the third arm is supported by the second arm in a state where the third arm is positioned on the sidewall side of the second arm, and a tube that supplies fluid to a painting gun attached to the wrist portion is arranged to the third arm along the sidewall side of the third arm.

14. The painting system according to claim 3, wherein the painting robot in a state of the reference posture is such that the second arm is cantilevered to the first arm in a state where the second arm is positioned on the object side of the first arm, the third arm is supported by the second arm in a state where the third arm is positioned on the sidewall side of the second arm, and a tube that supplies fluid to a painting gun attached to the wrist portion is arranged to the third arm along the sidewall side of the third arm.

15. The painting system according to claim 1, wherein the joint portion forming the fourth axis is configured to approach the sidewall by rotating the second arm about the third axis when the third axis is parallel to the sidewall.

* * * * *